United States Patent [19]

Cottell

[11] 3,941,552

[45] Mar. 2, 1976

[54] BURNING WATER-IN-OIL EMULSION CONTAINING PULVERIZED COAL

[76] Inventor: Eric Charles Cottell, Windermere, Bayville, Long Island, N.Y. 11709

[22] Filed: Oct. 29, 1974

[21] Appl. No.: 518,509

[52] U.S. Cl. ..... 431/2; 110/1 J; 110/7 S; 431/4

[51] Int. Cl.[2] ..... F23B 7/00

[58] Field of Search ..... 431/2, 4; 110/1 J, 7 S

[56] References Cited

UNITED STATES PATENTS

| | | | |
|---|---|---|---|
| 3,073,652 | 1/1963 | Reichl | 110/7 S |
| 3,746,257 | 7/1973 | Broad et al. | 239/102 |
| 3,823,676 | 7/1974 | Cook et al. | 110/1 J |

FOREIGN PATENTS OR APPLICATIONS

| | | | |
|---|---|---|---|
| 878,723 | 10/1961 | United Kingdom | 110/1 J |

*Primary Examiner*—Edward G. Favors
*Attorney, Agent, or Firm*—Robert Ames Norton; Saul Leitner

[57] ABSTRACT

Pulverized coal is slurried with water then oil or if desired oil and pulverized alkalis preferably lime or limestone is added and the mixture subjected to sonic vibrations with an energy density of at least 11.625 watts per cm$^2$. Liquid suspension is produced and any excess water or oil separates out as a separate phase. Normally excess oil is used and the excess oil phase can be recycled. The resulting dispersion is utilized and burned in a furnace. A clean flame is produced which has the characteristics of an oil flame and not a powdered coal flame. The addition of lime is optional as its purpose is to reduce sulfur dioxide in burning where the coal contains sulfur. If there is no sulfur or so little as to meet environmental standards the addition of lime may be omitted. The amount of lime is preferably at least about twice stoichiometric based on the sulfur content of the coal. Up to 80% of sulfur dioxide produced on burning can react with the lime and the calcium sulfate produced removed by conventional particle separators.

6 Claims, 4 Drawing Figures

BURNING WATER-IN-OIL EMULSION CONTAINING PULVERIZED COAL

BACKGROUND OF THE INVENTION

Coal is usually burned either in a bed or if pulverized and atomized in the form of fine particles. When the coal contains substantial amounts of sulfur this is transformed into oxides of sulfur, mostly sulfur dioxide, during combustion. Sulfur oxides constitute serious atmospheric pollutants and in recent years quite stringent standards have been set in the United States for the concentration of sulfur oxides which can be vented to the atmosphere. This has required either low sulfur coal, about 1% or less, or the coal can be treated to remove excessive sulfur. In either case, there is a substantial penalty. It has therefore been proposed to mix finely divided lime or limestone with the coal and during burning a considerable amount of sulfur dioxide is oxidized in the combustion process which always has excess oxygen and calcium sulfate is produced. The removal of the particulate calcium sulfate can be effected by conventional means such as electrostatic precipitation. Combustion is not as complete as could be desired and unless there is a very large excess of lime the amount of sulfur oxides removed can be insufficient in the case of high sulfur coals.

It is with an improved coal fuel that the present invention deals and problems such as explosion hazards in powdered coal plants that are not kept scrupulously clean are avoided.

SUMMARY OF THE INVENTION

In the present invention pulverized coal is used particle sizes below $100\mu$ and a considerable portion is normally much finer down to as fine as $1\mu$. This is approximately the same form of coal used for powdered coal burning. When the tiny coal particles are examined under a microscope the surface appears quite porous. The pulverized coal is slurried with water and then oil is added, such as ordinary heating oil and the slurry is then subjected to violent sonic agitation. Ordinarily the frequency is in the ultrasonic range, for example from 20,000–30,000 Hz., or even higher frequencies. While in practice frequently ultrasonic agitation is used high sonic frequency for example 15,000–20,000 Hz. can be used, therefore throughout this specification the generic term "sonic" is used which covers both audible and ultrasonic frequencies. It should be realized that intense agitation which produces strong cavitation is necessary and this is measured as intensity and not as power. In the present invention the intensity should be at least 11.625 watts per $cm^2$. Commonly intensities of around 38.75 to 54.25 watts per $cm^2$ or a little less are employed. While there is a definite lower limit for sonic intensity below which satisfactory fuels will not be produced, there is no sharp upper limit. However there is no significant improvement above 54.25 watts per $cm^2$ and higher intensities add to the cost of producing the fuel without resulting improvement. In other words, the upper limit is not a sharp physical limit but is dictated by economics.

So long as the energy density meets the specifications above, it does not make much difference how the sonic energy is produced and the present invention is not limited to any particular apparatus. A very practical sonic generator is a so called sonic or ultrasonic probe.

Longitudinal vibrations are produced as conventional, either by piezoelectric, magnetostrictive device or the like. The sonic generator proper is then coupled to a solid velocity transformer, sometimes called an acoustic transformer, which tapers down, preferably exponentially, ending in a surface of much smaller area than that coupled to the sonic generator. In accordance with the law of conservation of energy the distribution of the vibrations over the smaller surface requires that the surface move more rapidly. This results in a much greater energy density andd as the total power is being transformed from a larger area to a smaller area, this is referred to as a transformer by analogy with electrical transformers which can step up voltage. Sonic probes of the type described above are commercial products and sold, for example by Branson Instruments under their trade name of "Sonifier." This type of apparatus for producing high sonic energy density, which should not be confused with sonic power, is a very economical and satisfactory type of producing the necessary sonic energy intensity. In a more specific aspect of the present invention the use of this type of instrument is included but of course the exact way the vibrating surface is energized is not what distinguishes the present invention broadly from the prior art.

The high intensity sonic agitation appears to drive water into the pores of the porous coal particles and then produces a water-in-oil type of emulsion. This is not a true emulsion because it includes suspension of the tiny coal particles as well as a dispersion of oil and water. However, the behavior of the resulting product which is a somewhat viscous liquid is not that of a typical emulsion. In a typical water-in-oil emulsion, the continuous oil phase can be diluted with more oil to produce a more dilute emulsion. In the case of the present invention, however, when an excess of oil is used oil separates as a separate phase, in this case a supernatant phase. While it is theoretically possible with an exact ratio of coal, water and oil to produce a product that does not separate out any oil phase as a practical matter this is undesirable because the separation it too critical and it is much better to operate with a small excess of oil and separate and recycle the supernatant phase. Although, as has been pointed out above, the product of the present invention is not technically a water-in-oil emulsion it has some properties that are similar. Thus, for example, after removing a supernatant oil phase the remaining oil and water remains stable in and around the coal particles and the product can be stored for a reasonable time without further separation of the components. For this reason the product will be referred to in the specification as an emulsion even though technically it is not a true emulsion. It is, however, a dispersion of the coal particles and tiny water droplets and, as pointed out above, it is stable. When the product or fuel of the present invention is burned it burns very cleanly with a flame of the color and characteristics of an oil flame rather than a powdered coal flame. Apparently during combustions there is not a physical production of fine coal particles although the exact mechanism of combustion has not been completely determined and the present invention is therefore not intended to be limited to any particular theory.

The exact proportion of coal, water and oil is not critical, which is an advantage. It will vary a little with the gravity of the oil and with particular coal an excellent practical ratio is about 20 parts of pulverized coal, 15 parts of oil and 10 parts of water. This product settles out only a little oil as a supernatant liquid and a very stable dispersion results. However, somewhat more oil may be used and in some cases is desirable because the separated oil phase can easily be recycled, and therefore the above ratio of ingredients is illustrative of a typical useful product. It should be noted that if there is an excess of water this also can separate a portion of water as a separate phase. For practical operation it is usually desirable to have any excess in the form of oil.

The violent sonic agitation also performs an additional function. It reduces the particle size of the coal, possibly because of coal particles striking each other during the violent agitation. The exact amount of reduction of particle size depends both on the energy density of the sonic agitation and on the character of the particle coal. A more fragile coal will, of course, be reduced somewhat more but the final size range still remains between about $1\mu$ and about $100\mu$.

While the dispersion is fairly viscous it still flows readily and does not have to be heated prior to supplying it to the burner. This is an advantage over burning highly viscous residual fuel oils which have to be heated by steam before being atomized in a burner. This is one of the advantages of the present invention as it permits eliminating heating equipment without eliminating its function.

The actual atomization in a burner is not what distinguishes the present invention from the prior art and any suitable form of a burner can be used. One such form is a sonic probe which atomizes the dispersion of fuel from its end.

Where the coal used is of low sulfur so that sulfur oxide emissions from a furnace stack are within environmental standards the fuel of the present invention may constitute only pulverized coal, oil and water, however, the present invention makes possible elimination of a large amount of sulfur oxides in a very simple and economical manner. This opens up cheap, high sulfur coal for use where it would otherwise not meet environmental standards. When it is desired to reduce sulfur oxide emissions preferably finely pulverized lime or limestone may be dispersed in the water. This will be generally referred to as lime and it may be introduced in the process of the present invention either before or after oil introduction, preferably it is introduced substantially simultaneously when feeding to the sonic emulsifier. It should be noted ordinarily pulverized lime will be fed in in the form of a water slurry and the water content must be taken into consideration in the total amounts of water in the final product. When the pulverized lime is introduced it forms part of the suspension and is stable and does not settle out on standing. This avoids any distinct problems and is a further advantage of the aspect of the present invention where sulfur oxides are decreased.

Lime is the preferred alkali to use when high sulfur coal is to be burned. It has many practical advantages such as low cost and the fact that the calcium sulfate which is produced in the flame has very low solubility in water. Other alkalis may be used such as for example sodium carbonate. Most of these other alkalis form sulfates which have considerable solubility in water. As water vapor is always produced in the burning of the fuel this can present problems particularly as at some stage of the stack gas treatment temperatures are reduced and liquid water may condense out. In such a case it can form somewhat pasty masses with alkalis, the sulfates of which are fairly soluble in water. This makes electrostatic precipitation more difficult, as the precipitator normally requires that the particles which it removes be dry. There is also a possibility in other parts of the combustion gas treatment equipment for deposition of pasty sulfates to result. This requires additional cost for cleaning and is one of the reasons why lime is the preferred alkali. However, other alkalis may be used and in its broadest aspect the invention is not limited to the use of lime although this is the preferred material.

The removal of sulfur oxides depends on the amount of lime or other alkali. The lime should normally be in excess over the stoichiometric value based on the sulfur content of the coal. The more lime used the greater reduction. For example with a 50% excess 50% of the sulfur oxides may be eliminated or rather fixed as calcium sulfate. When more lime is used the sulfur oxide reduction becomes greater reaching about 80% when the lime is in twice stoichiometric ratio. The additional removal of sulfur with still more lime occurs more slowly as the curve tends to asymptote and therefore ordinarily much greater excesses than twice stoichiometric are not economically worthwhile. With quite high sulfur coal the the approximate 80% reduction brings the fuel within environmental standards. Lime, while not a very expensive material still adds to the cost and in some cases with lower sulfur coals a 50% sulfur oxide removal brings the fuel within environmental standards and in such cases smaller excesses of lime may be used. This is an economic question and there is no sharp upper limit. Theoretically calcium sulfate (gypsum) which is recovered by electrostatic precipitation or other means can be sold. However, the cost of producing the recovered gypsum may be more than its sale price so, where unneeded for environmental purposes, smaller lime excesses can present an economical advantage and are of course included.

DESCRIPTION OF THE PREFERRED EMBODIMENTS

Figure 1:
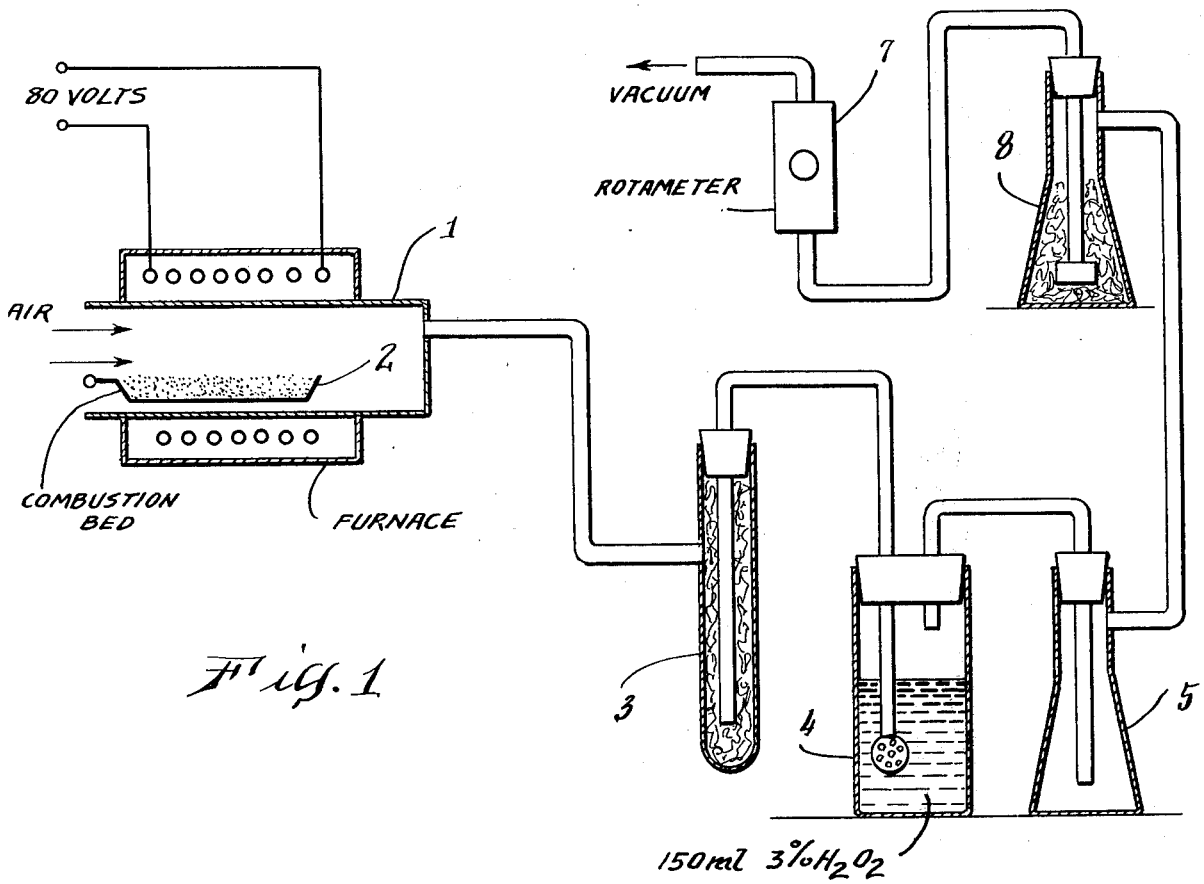
FIG. 1 is a diagrammatic showing of an experimental furnace burning the coal dispersion in a bed.
Figure 2:
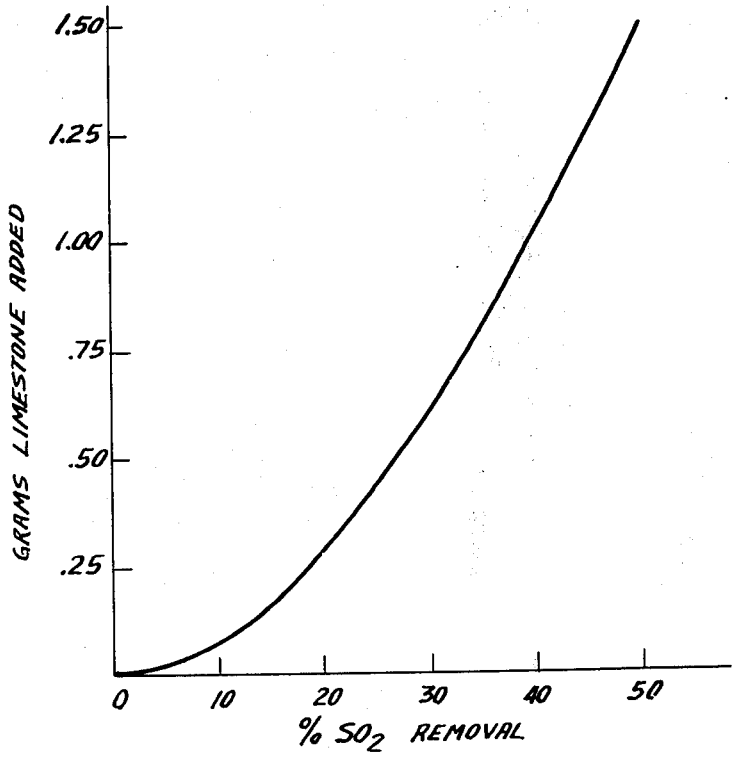
FIG. 2 is a curve showing $SO_2$ removal for various amounts of lime up to 50% excesses.

FIGS. 1 and 2 deal with an experimental set up in which the coal dispersion is burned in a bed. The coal dispersion is typically produced by dispersing 20 parts of coal in 10 parts of water adding 15 parts of oil, such as No. 2 heating oil, and subjecting the product to violent ultrasonic agitation with an energy density of between 38.75 to 54.25 watts per $cm^2$. In order to permit rapid dispersion the thickness of the liquids in contact with the vibrating surface is of significance, for example, in an ultrasonic probe which will be described in combination with FIG. 4. The thickness of the liquid layer is not sharply critical, but should be normally considerably less than the diameter of the vibrating surface. If the thickness of liquid becomes much greater the output is reduced although if sufficient time is given a satisfactory dispersion can be produced in quite a thick liquid layer, however, this is economically undesirable. Obviously, of course, the thickness of the layer of the suspension between the vibrating surface and container must be greater than the dimensions of the largest coal particles. As has been stated above, the particular size range is from about 1$\mu$ to about 100$\mu$. Although it is not practical to get an exact measurement the dispersion appears to be fairly uniform.

The present invention is not limited to any particular finely divided coal. Typical coals in the specific embodiments to be described are an eastern bituminous coal having from 1 to 2% of sulfur. Another typical coal is a western Kentucky coal having slightly more sulfur.

To produce a coal dispersion which will reduce sulfur oxide production on combustion pulverized lime in a water slurry is introduced at about the same time as the oil. The water in this slurry must of course be taken into consideration for the water proportion. If the coal is very low sulfur a lime excess of around 50% of stoichiometric can be used. For higher sulfur coals, for which the present invention is particularly advantageous, the excess should be about twice stoichiometric.

Turning back to FIG. 1 the experimental furnace is shown at (1) and is preheated electrically as is shown by the wires going to a surrounding electrical heating jacket. In the experimental set up the furnace was a cylindrical furnace about 1.25 inches in diameter. The coal dispersion is introduced and forms a bed on a suitable burning grate (2). Air is introduced as is shown and the amount of air should be approximately that corresponding to most economical combustion, i.e. a slight excess of air. The gases from the burning bed pass into a sidearm testube (3) which is filled with glass wool. This removes some solids and other impurities and then passes into a water scrubber (4) which in the experimental set up contains water with about 3% hydrogen peroxide. Then the gases pass on to a trap (5) and to a water trap (6) both in the form of sidearm flasks, the latter containing glass wool. The gases are pulled through by a partial vacuum as indicated on the drawing from any source, (not shown). Flow is measured by a rotameter (7).

Results of the tests are shown in the following table 1:

The first four runs were burned in a bed, the fifth run atomized the fuel from the end of an ultrasonic probe. The sulfur oxide removal versus lime is shown as a graph up to 50% excess in FIG. 2. When the excess becomes greater than twice stoichiometric the curve flattens out or asymptotes at about 80% removal. In other words, in such a range the curve is actually an S. Curve.

Figure 3:
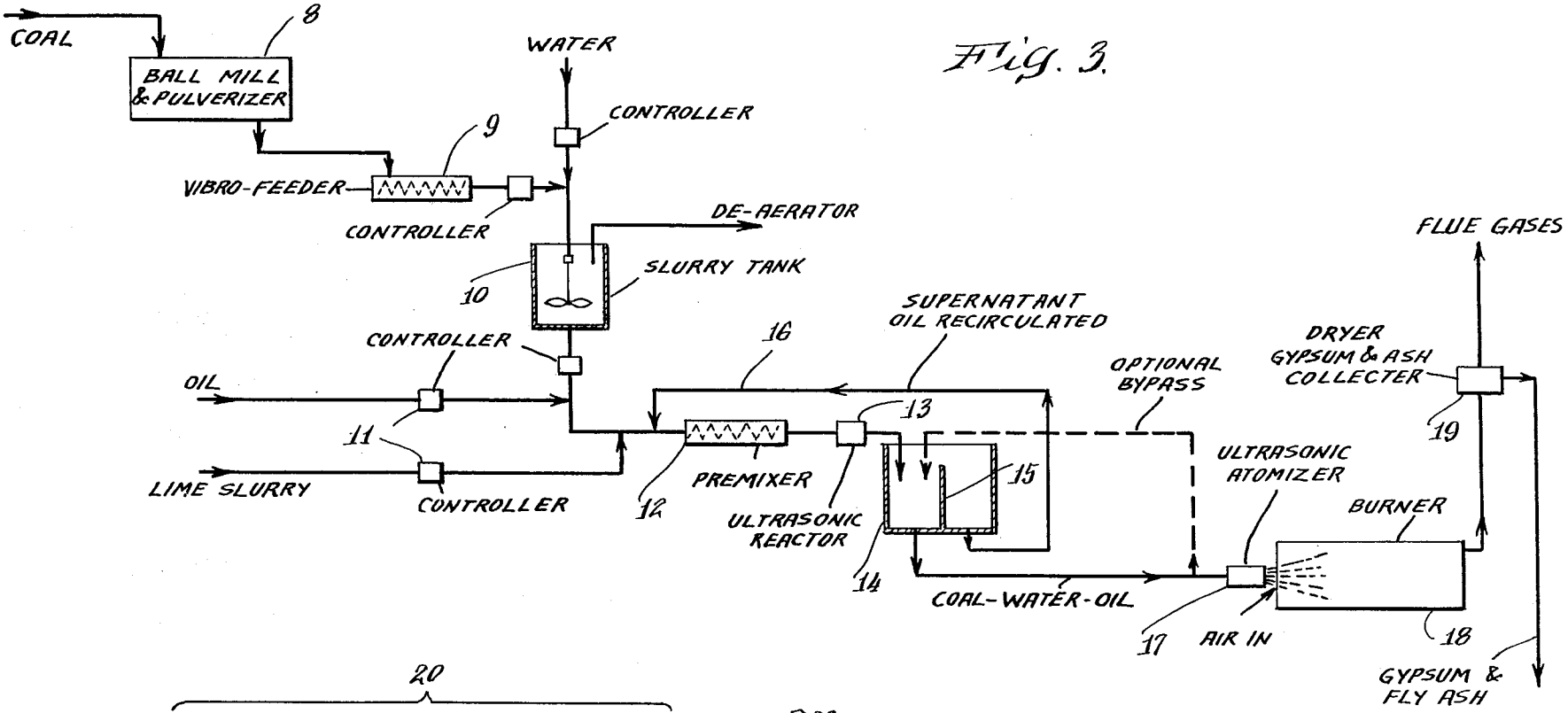
FIG. 3 is a diagrammatic flow sheet of a practical installation atomizing the coal dispersion to form a flame.

FIG. 3 is a diagrammatic illustration of a practical flow sheet for a large plant. In this case the combustion is by atomizing the fuel from an ultrasonic probe. Coal, as shown on the drawing, is pulverized in a ball mill and pulverizer (8) and reduced to a particle size of less than 100$\mu$, with some of the particles as small as 1$\mu$. The coal is then fed by a vibro-feeder (9) into a stream of water flowing at a controlled rate into a slurry tank (10). Slurrying is effected by a conventional propeller, a vent to the air providing deaeration. The slurry then passes through a controller and oil controlled by controller (11) is introduced and a little further on a lime slurry passes through in the controller (11). The proportion of lime to sulfur in the coal is about twice stoichiometric.

The slurry is then premixed in a premixer (16). The premixed slurry is then introduced into a sonic disperser (13) in this disperser an ultrasonic probe operating at between 20,000–22,000 Hz of the type shown in FIG. 4 which will be described below and the end of the probe which is operated from the front of the container (13) to produce a thickness of liquid substantially less than the cross sectional dimension of the end of the probe. Violent sonic agitation with cavitation resulted in the energy intensity being about 38.75 to 54.25 watts per cm2. A stable dispersion is produced which flows into a separator (14) provided with a weir (15) this weir permits some supernatant oil to flow over into a compartment from which the recycling line (16) recycles it to the premixer (12).

The coal-water-oil-lime then flows into another ultrasonic probe housing (17) and is atomized from the end of the ultrasonic probe into a combustion chamber (18). It is burned and the flue gases pass through a particulate separator in the form of an electrostatic precipitator (19) this removes finely divided calcium sulfate which can be recovered and sold. With coal having 2–3% sulfur the removal of sulfur dioxide is about 80% which brings the flue gases to environmental standards.

TABLE 1

Removal of $SO_2$ by Limestone in coal-oil-water suspension

| Run No. | Type of Burn | (Grams) | Oil (Grams) | $H_2O$ (Grams) | Limestone (Grams) | Fuel Burnt Grams | 16N NaOH ($SO_2$ titrate) ml | $SO_2$ removal % |
|---|---|---|---|---|---|---|---|---|
| 1 | Bed | 20 | 20 | 5 | 0 | 9.5 | 6.3 | 0 |
| | | 20 | 20 | 5 | .48 | 10.0 | 4.4 | 33 |
| | | 20 | 20 | 10 | 0 | 8 | 7 | 0 |
| 2 | Bed | 20 | 20 | 10 | .48 | 7 | 4.5 | 26 |
| 3 | Bed | 20 | 20 | 10 | 0 | 10 | 9 | 0 |
| | | 20 | 20 | 10 | 1.5 | 10 | 4.9 | 44 |
| 4 | Bed | 20 | 20 | 10 | 0 | 6 | 4.8 | 0 |
| | | 20 | 20 | 10 | 1.5 | 6 | 2.4 | 50 |
| 5 | Atomized | 20 | 15 | 10 | 0 | 6.9 | 2.5 | 0 |
| | Fuel Spray | 20 | 15 | 10 | 1.5 | 16 | 3.0 | 50 |

It will be seen that Table 1 includes a number of tests made with varying amounts of oil and water and in each case included no finely divided lime or the number given in the table 1. This table also gives the amount of fuel burnt and sulfur oxides were measured by titrating with a sodium hydroxide solution.

Figure 4:
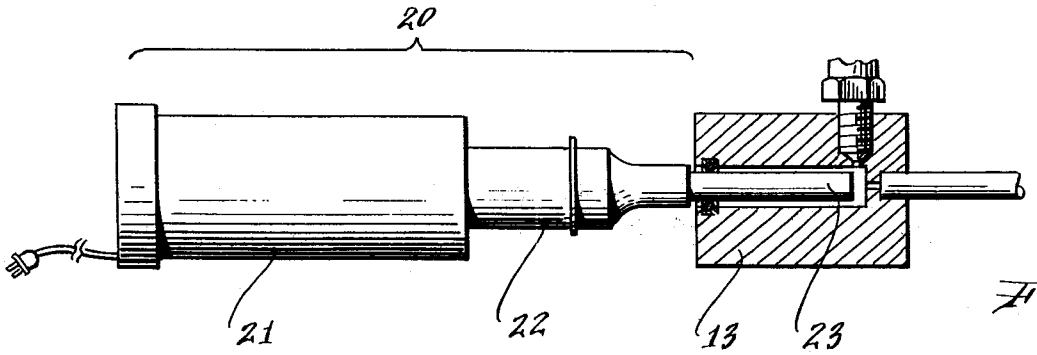
FIG. 4 is a semi-diagrammatic illustration of an ultrasonic probe.

FIG. 4 is a semi-diagrammatic showing of a typical ultrasonic probe (20). Ultrasonic vibrations from 20,000–22,000 Hz result from electricity at the same frequency which is shown coming in through wires. The vibration is in a piezo-electric stack (21) to which is coupled the broad end (22) of a steel velocity transformer which tapers exponentially to a small end (23). It is this end which agitates the dispersion in the agitator (18) on FIG. 3 and a similar probe produces atomization as indicated at (17) in FIG. 3.

Combustion of the atomized fuel produces a flame which is clear and results in complete combustion and which does not have the appearance of a flame from pulverized coal combustion. The presence of water in the fuel dispersion is probably what assures the flame-quality and which permits very complete combustion. The combustion is so complete that there is very little if any loss in heating due to the presence of water which, of course, is flashed into steam as the dispersion burns.

I claim:

1. A process of producing a fuel in the form of a dispersion comprising mixing of finely divided coal, with particle size less than $100\mu$, with water to form a slurry, adding oil to the slurry and the liquids, subjecting the mixture to violent sonic agitation with an intensity of more than 11.625 watts per $cm^2$, thus producing a stable dispersion, whereby the coal does not settle out, removing any excess oil forming a separate phase, whereby a coal-water-oil dispersion is produced which is stable to storage.

2. A process according to claim 1 in which the coal has a sulfur content which on combustion would produce more sulfur oxides than meets environmental standards, which comprises introducing into the coal and water slurry in addition to the oil a dispersion of an alkali, the amount of the alkali being at least about 50% in excess of stoichiometric based on the sulfur content of the coal, and atomizing the coal dispersion in the presence of air to form a flame and removing sulfate produced from the stack gases from the combustion.

3. A process according to claim 2 in which the dispersion of alkali is a slurry of pulverized lime or limestone.

4. A process according to claim 3 in which the lime or limestone is at least about twice stoichiometric based on the sulfur content of the coal.

5. A process according to claim 1 in which the coal is in excess by weight over the water.

6. A process according to claim 3 in which the coal is in excess by weight over the water.

* * * * *